United States Patent [19]

Park

[11] 4,067,291

[45] Jan. 10, 1978

[54] COATING SYSTEM USING TAPE ENCAPSULATED PARTICULATE COATING MATERIAL

[75] Inventor: John Allen Park, Houston, Tex.

[73] Assignee: H. B. Zachry Company, San Antonio, Tex.

[21] Appl. No.: 654,014

[22] Filed: Jan. 30, 1976

Related U.S. Application Data

[62] Division of Ser. No. 458,898, April 8, 1974, abandoned.

[51] Int. Cl.[2] ..... B05B 7/00; B05C 5/00

[52] U.S. Cl. ..... 118/7; 29/421 E; 118/50; 118/308; 427/180

[58] Field of Search ..... 118/7, 50, 50.1, 308; 427/180, 422, 423; 29/421 E; 228/107

[56] References Cited

U.S. PATENT DOCUMENTS

| | | | |
|---|---|---|---|
| 2,714,563 | 8/1955 | Poorman et al. | 427/180 X |
| 2,861,900 | 11/1958 | Smith et al. | 427/423 |
| 2,972,550 | 2/1961 | Pelton | 427/191 |
| 3,135,626 | 6/1964 | Moen et al. | 427/423 |
| 3,371,404 | 3/1968 | Lemelson | 228/107 |
| 3,461,268 | 8/1969 | Inoue | 118/49.5 X |
| 3,644,984 | 2/1972 | Inoue | 29/421 E |
| 3,801,346 | 4/1974 | Melton et al. | 427/180 |

*Primary Examiner*—Mervin Stein

*Attorney, Agent, or Firm*—Hubbard, Thurman, Turner, Tucker & Glaser

[57] ABSTRACT

A system for coating work pieces with particulate material is disclosed. A predetermined quantity of the particulate coating material is encapsulated per unit length of a polyethylene tape. The encapsulating tape is then moved at a controlled rate past a stripping station where the particulate material is stripped from the encapsulated tape and entrained in a gaseous stream. The gaseous stream injects the particulate material into a chamber having an open inlet in which the particulate material is both heated and accelerated to a high velocity for impacting a work piece and thus form a coating. In one embodiment of the invention, the particulate material is encapsulated in a plurality of discrete pockets, each containing a measured quantity of the particulate material. The particulate material is stripped from the package by pneumatic pressure and injected in the combustion chamber in timed sequence with ignition of a charge of combustible gases. In another embodiment of the invention, the particulate material is encapsulated in a continuous tubular system, and is continuously stripped from the tape and fed into a chamber in which the gases and particles are continually heated by combustion or an electric arc. In either embodiment, the particulate material may be stripped from the encapsulating tape either by pneumatic pressure or by mechanical means, or by a combination of both.

32 Claims, 14 Drawing Figures

COATING SYSTEM USING TAPE ENCAPSULATED PARTICULATE COATING MATERIAL

This is a division of application Ser. No. 458,898, filed Apr. 8, 1974. now abandoned.

This invention relates to systems for coating a work piece with particulate material, and more particularly relates to apparatus for packaging, storing and applying the particulate material in a more controlled manner to produce a superior quality coating.

Co-pending application Ser. No. 198,806, entitled "Method and Apparatus for Applying Particulate Coating Material to a Piece of Work", filed on Nov. 15, 1971 on behalf of Melton, et al, now U.S. Pat. No. 3,801,346, and assigned to the assignee of the present invention, and U.S. Pat. No. 2,972,550 disclose systems for applying particulate coating material, such as tungsten carbide, to a work piece in a series of pulses.

The system disclosed in the former utilizes a combustible fuel-air mixture which is introduced to a combustion chamber having a restricted outlet nozzle at a sufficient rate to increase the pressure substantially above atmospheric pressure. The inlet valve is then closed and the mixture ignited while the pressure is still at a high level. The resulting combustion produces a still higher pressure as a result of confinement by the restricted outlet nozzle, and the hot gases of combustion then exit through the restricted outlet nozzle at a high velocity during a blow-down period. The particulate material is injected into the combustion chamber, preferably near the end of combustion, and before the peak pressure has been materially reduced. As a result, the particulate material is both heated and propelled from the nozzle against the work piece at a high velocity where the particulate material flattens and adheres to the work piece to form the coating.

The system disclosed in U.S. Pat. No. 2,972,550 utilizes somewhat the same technique, except that a detonable mixture must be used in a long, open-ended tubular combustion chamber designed particles sustain a detonation wave. The detonation wave results in a substantially instantaneous pressure rise within the chamber as a result of the very rapid combustion. Again, the hot gases heat the particles, which must be injected just prior to detonation, and the high pressure cuases the gases to rush from the open end of the tube thus propelling the par;ticles at high velocity against the work piece.

In each of these systems, the repetitive rate of the combustion pulses is relatively high, on the order of ten per second, for example. Both the coating efficiency, i.e. the per cent of particles which adhere to the work piece and the quality of the coating are highly dependent upon injecting the particles into the combustion chamber in uniformly repetitive quantities at precisely the right instant. One of the principal difficulties with each of the previous systems resided in the particle injection systems employed. Each system has utilized a bulk hopper for the particulate material and some type of mechanical-pneumatic dispensing system for measuring and injecting the very small quantity of particulate material required for each "shot". Bulk handling of the particulate material results in undesirable segregation of large particles from small particles. Such systems are also generally unreliable because the particulate material tends to cake and feed unevenly from the bulk hopper. Further, the high speed pneumatic transport of the highly abrasive particulate material results in extremely rapid abrasion of the penumatic valving and conduits which as a consequence fail often. Further, many particulate materials are subject to oxidation and other adverse effects as a result of being subjected to humidity of the atmosphere, and protection from oxidation is very difficult during bulk handling of these materials at the coating site.

Similar problems also exist in continuous coating systems, such as flame guns and plasma guns, where particulate material is continuously fed to the hot gases by a pneumatic feed system. In some such systems, rods or tubes containing particulate material have been fed directly into the combustion chamber where the hot gases of combustion melt the rod or tube and the entire material is either consumed by the flames or becomes a part of the coating material. However, in most instances, particulate material is pneumatically conveyed over substantial distances from a bulk hopper to the coating gun, resulting in abrasion of the apparatus and clogging of the system.

U.S. Pat. No. 3,461,268 discloses a system wherein particulate material is encapsulated in pockets of a foil tape and physically positioned to form one wall of a high voltage spark chamber. The spark in the chamber results in an explosion which propells both the heated particles and the material forming the package against the work piece to form a coating. While such a system may be suitable for some types of coating, the entrainment of the material forming the encapsulating tape materially and adversely affects the quality of coatings of the type of interest in the present application.

In accordance with the present invention, particulate coating material is encapsulated in an elongated tape with each unit length of the tape containing a predetermined quantity of the particulate material. The tape is moved past a stripping station at a controlled rate and the particulate material is stripped from the tape and entrained in a carrier gas stream which injects the particulate material into a system for heating the particles and gaseous stream and directing the particles in a high velocity hot gaseous stream through an outlet to impact the heated particles against a work piece and thus form the coating.

In one specific embodiment of the invention, a pulse-type coating system is employed which is comprised of a combustion chamber having an open outlet, means including an inlet valve for introducing a series of discrete combustible charges to the combustion chamber, an ignition system for igniting the combustible charge in the combustion chamber, an encapsulating tape having a plurality of discrete pockets each including a measured quantity of particulate coating material, a source of pneumatic pressure, a stripping station, means for sequentially moving the encapsulating pockets of the tape to the stripping station, and control means for producing a series of discrete combustion cycles during which the particulate material is stripped from the encapsulating tape and injected into the combusting gases. Because of the unusally high degree of control available over the particulate material, the point of injection into the combustion chamber can be controlled to compensate for different size and different types of coating material. Claims are directed to the combination and subcombinations of this embodiment of the invention, as well as to various aspects of the method.

In another embodiment of the invention, a continuous coating apparatus is provided including a source of fuel gas and oxidizer gas which are mixed in a combustion chamber and ignited so that the hot gases of combustion leave the combustion chamber at high velocity. Particulate material encapsulated in a continuous tape is continuously moved by a stripping station and a combination of pneumatic and mechanical means strip the particulate material from the tape and injects into the combustion chamber of the flame gun.

In still another specific embodiment of the invention, a plasma coating system is provided in which a gaseous stream is heated by an electric arc and expelled at high velocity as a result of the heating against a work piece. Particulate material encapsulated in a tape is moved by a stripping station and a combination of pneumatic and mechanical means strip the particulate material from the tape and injects it into the gaseous stream either before or after the gaseous steam is heated by the electric arc. The particles are then heated and impacted against the work piece to form the coating.

The novel features believed characteristic of this invention are set forth in the appended claims. The invention itself, however, as well as other objects and advantages thereof, may best be understood by reference to the following detailed description of illustrative embodiments, when read in conjunction with the accompanying drawings, wherein:

Figure 2:
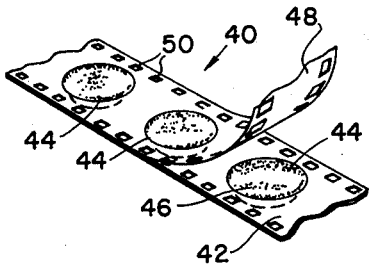
FIG. 2 is a perspective view of an elongated tape encapsulating particulate material in accordance with the present invention.
Figure 2B:
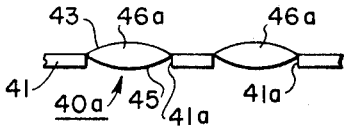
Figure 2A:
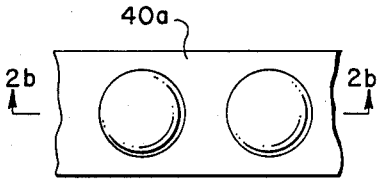

FIG. 2*a* is a plan view of another encapsulating tape in accordance with the present invention;

FIG. 2*b* is a section of view taken substantially on lines 2*b*—2*b* of FIG. 2*a;*

Figure 1:
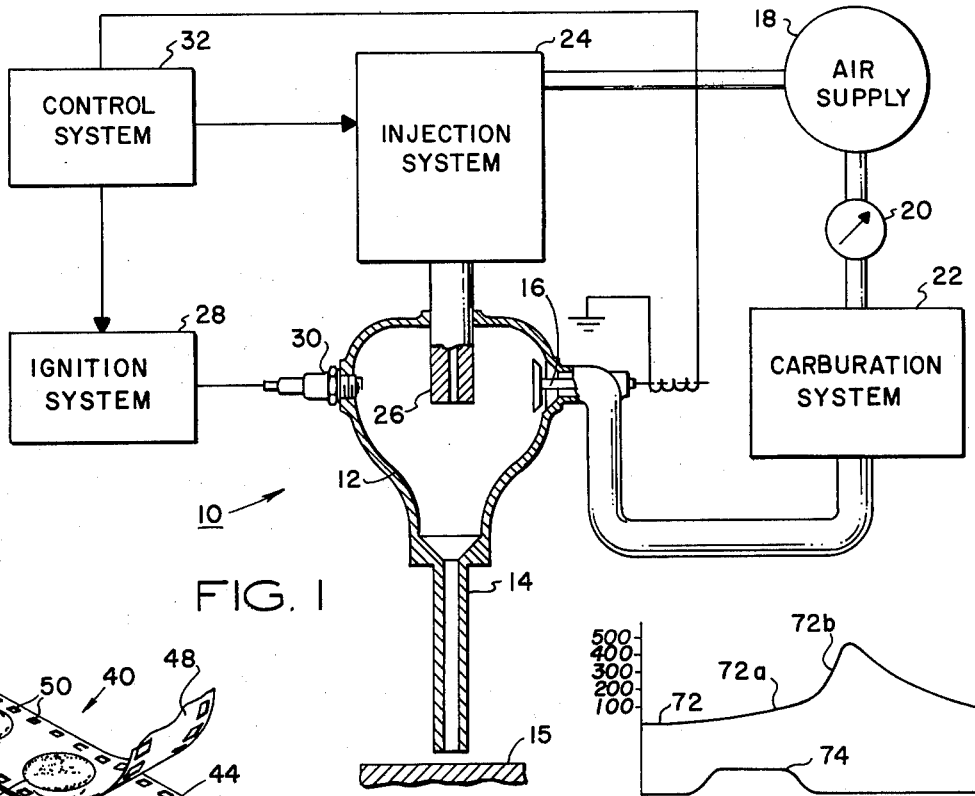
FIG. 1 is a schematic block diagram illustrating a method and apparatus in accordance with the present invention.
Figure 4:
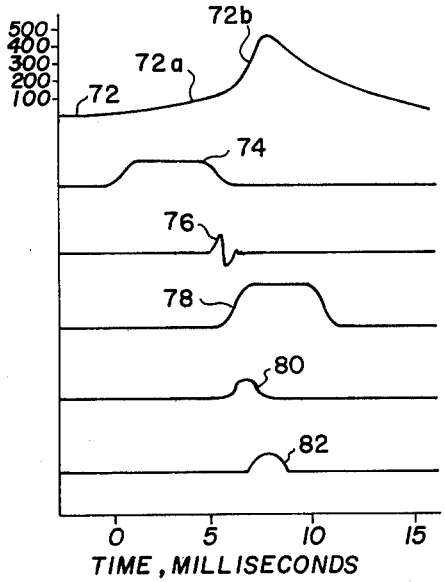
Figure 3:
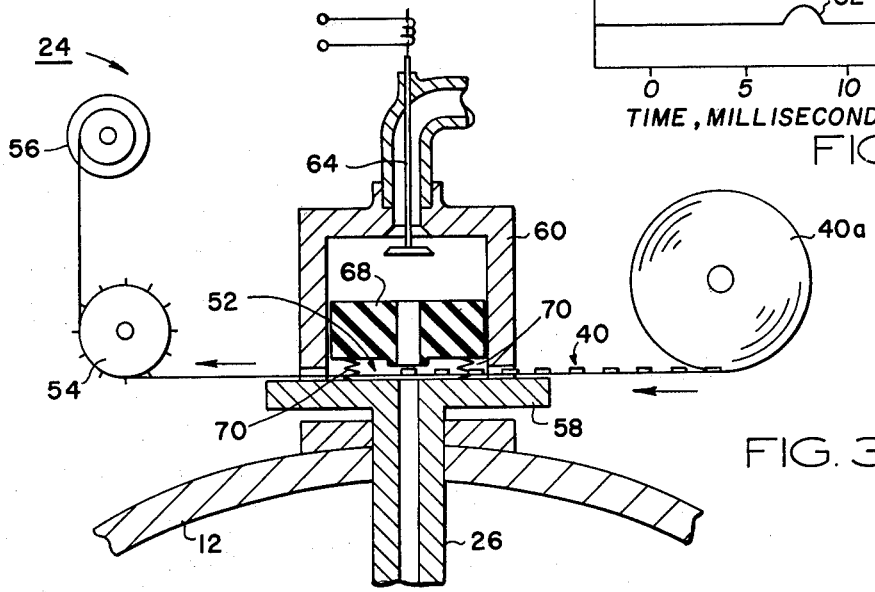
Figure 6:
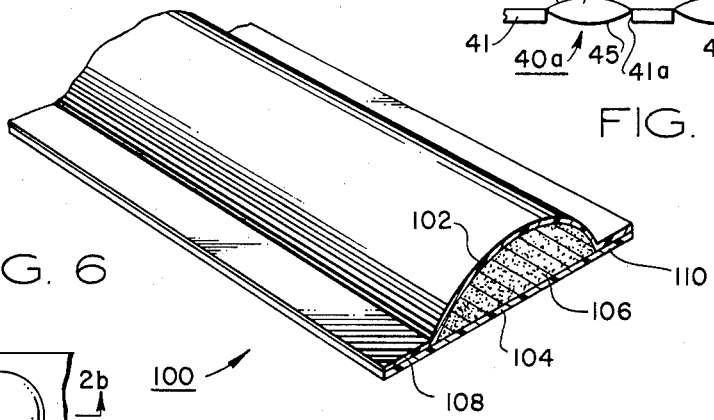
Figure 7:
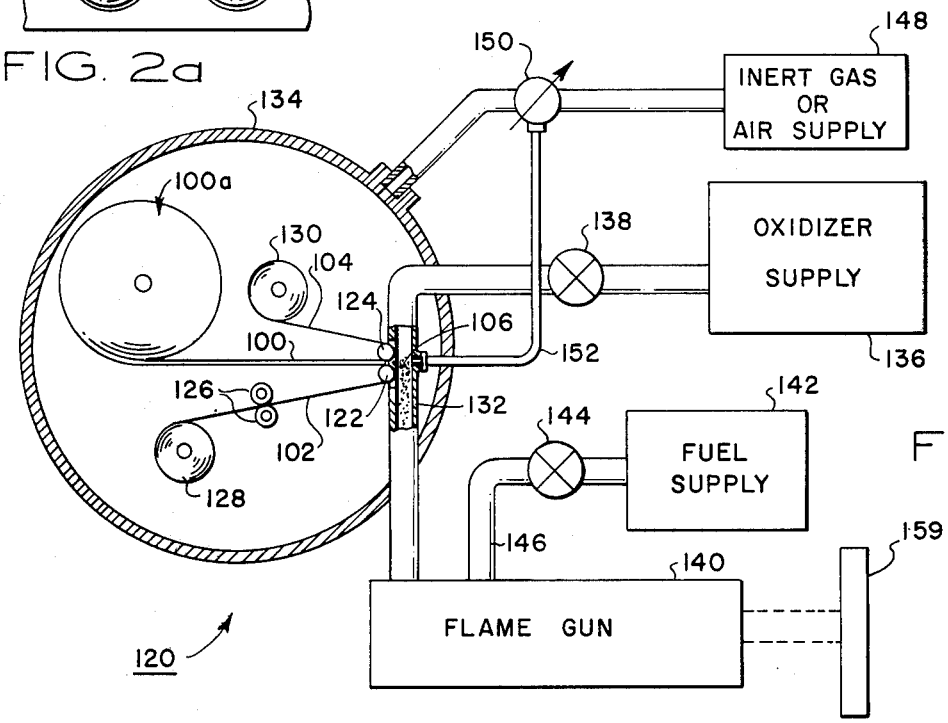
Figure 5:
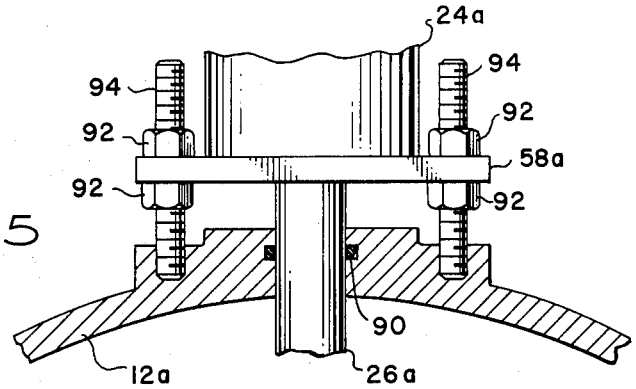
Figure 8:
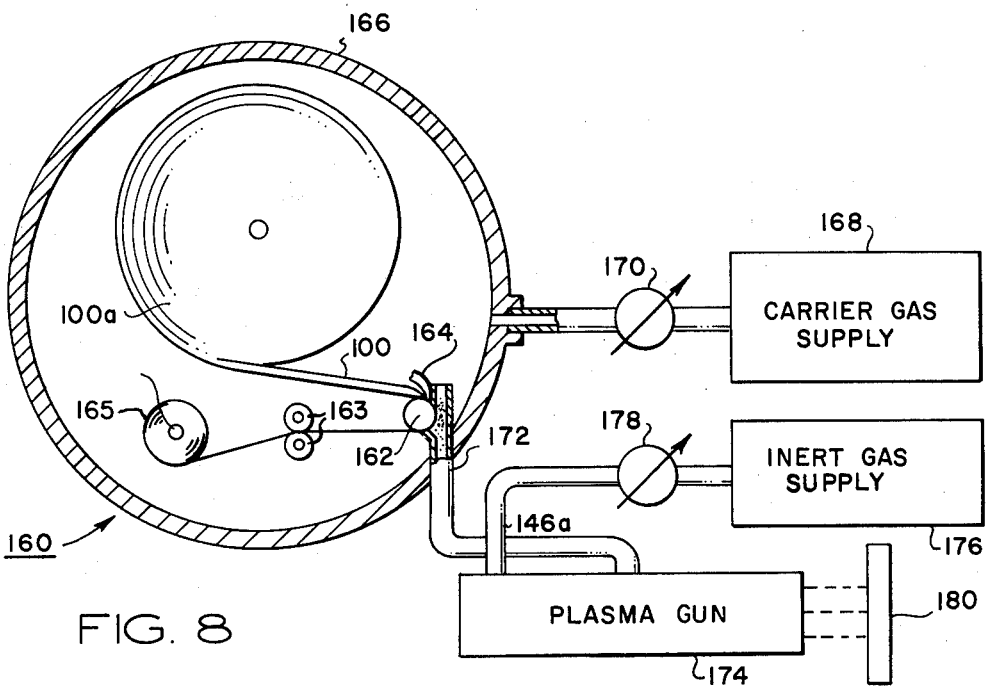
Figure 9:
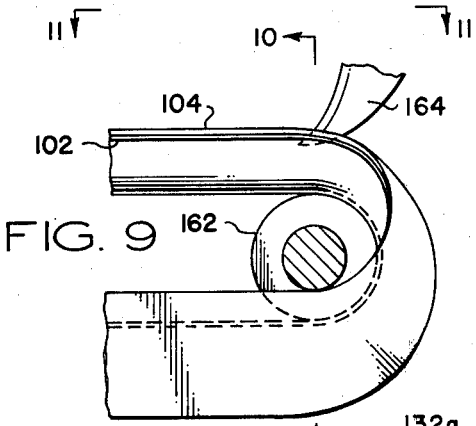
Figure 10:
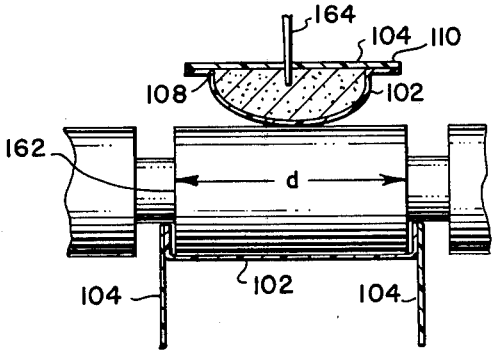
Figure 11:
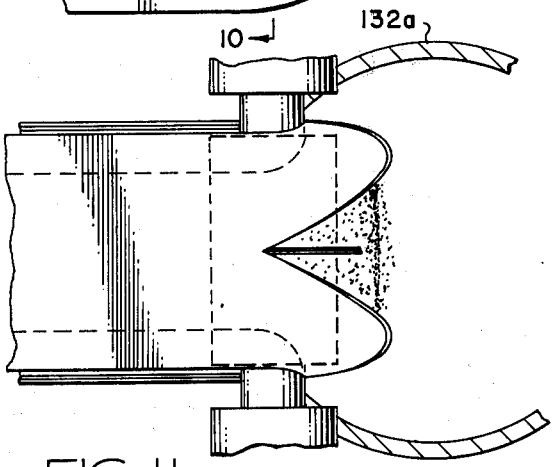
Figure 12:
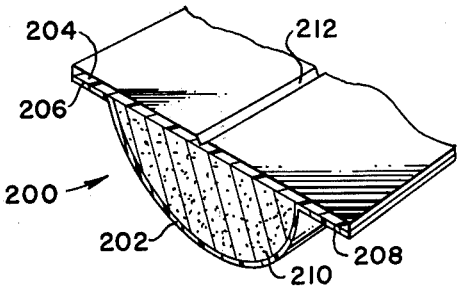

FIG. 3 is a simplified cross-sectional view of the injection system of the apparatus of FIG. 1 which utilizes the encapsulating tape of FIG. 2;

FIG. 4 is a timing diagram which serves to illustrate the operation of the apparatus of FIG. 1;

FIG. 5 is a partial sectional view of an alternative embodiment of the apparatus of FIG. 1 which illustrates another aspect of the present invention;

FIG. 6 is a perspective view of another encapsulating tape in accordance with the present invention;

FIG. 7 is a simplified block diagram illustrating method and apparatus for using the tape of FIG. 6;

FIG. 8 is a simplified diagram illustrating still another method and apparatus for utilizing the encapsulating tape of FIG. 6;

FIG. 9 is a simplifed enlarged side view of the stripping station of the apparatus of FIG. 8;

FIG. 10 is a sectional view taken substantially on lines 10—10 of FIG. 9;

FIG. 11 is a sectional view taken substantially at lines 11—11 of FIG. 10; and FIG. 12 is a simplified perspective view, partially in section, of still another encapsulating tape in accordance with the present invention which can be used in the system of FIG. 7.

A system in accordance with the present invention is indicated generally by the reference numeral 10 in FIG. 1. The system 10 includes a generally spherical combustion chamber 12, having an elongated, restricted outlet nozzle 14 which directs hot gases of combustion and particulate material entrained therein against a work piece. An inlet valve 16, which is relatively large compared to the outlet nozzle, admits a fuel-air mixture to the chamber. An air supply 18 provides compressed air at a relatively high pressure, typically 1,000 p.s.i., through a pressure regulator 20 which provides 100 p.s.i. to a carburation system 22, where a gaseous fuel is mixed with the air and the mixture fed through the inlet valve into the combustion chamber. The high pressure air is also directed to an injection system 24 which will presently be described in greater detail. An injector tube 26 extends from the injection system 24 into the combustion chamber 12. A conventional ignition system 28 ignites the combustible mixture supplied to the chamber 12 by means of a spark plug 30. A timing system 32 controls the inlet valve 16, the ignition system 28 and the injector 24, in a sequence which will be presently described in connection with the timing diagram of FIG. 4.

Referring now to FIG. 2, an encapsulated tape in accordance with the present invention is indicated generally by the reference numeral 40. The encapsulating tape 40 includes a relatively thick tape member 42 in which are formed a series of pockets 44 at uniformly spaced intervals. Each pocket 44 is filled level full with a measured quantity of particulate coating material 46. The particulate coating material is sealed in the pockets 44 by a relatively thin sheet of material 48. The sheets 42 and 48 are preferably a plastic material, such as polyethylene, but may be a moisture-proof material where such a seal is desired. The relatively thick sheet 42 may be on the order of 0.004 inches thick, while the relatively thin sheet 48 may be on the order of 0.0005 inches thick. Each pocket is typically on the order of ⅛ inch to ¼ inch in diameter, depending upon the particular application. A series of perforations 50 may be provided along either or both edges of the laminated tape structure to provide a positive indexing system, as will be described in connection with FIG. 3.

An alternative embodiment of the encapsulating tape in accordance with the present invention is indicated generally by the reference numeral 40*a* in FIGS. 2*a* and 2*b*. The tape 40*a* includes a relatively thick carrier strip 41 having aperatures 41*a* at each capsule site. Particulate material 46*a* is encapsulated between a pair of relatively thin film strips 43 and 45 and each capsule is disposed within an opening 41*a*. The film strips 41, 43 and 45 may be any suitable plastic material, such as polyethylene, and are bonded together at the common points by heat or other suitable means. The relatively thick sheet 41 may be of the same thickness as sheet 42 in FIG. 2 and the relatively thin sheets 43 and 45 of approximately the same thickness as the thin sheet 48 of FIG. 2. The tape 40*a* increases the ease and efficiency with which the capsules may be burst by pneumatic pressure, yet provides sufficient strength for high speed indexing and handling.

Referring now to FIG. 3, the injection system 24 includes a suitable system (not illustrated) for feeding the encapsulating tape 40 from a supply reel 40*a* past a stripping station, indicated generally by the reference numeral 52. The tape may be pulled past the station by an indexing drive sprocket 54 and then wound on a suitable take-up reel 56. The stripping station 52 includes an outlet mandrel 58 supported on the end of the injection tube 26 and an inlet header 60 which includes a solenoid operated valve 64 to admit air from the high pressure air which forms a carrier gas stream. A penumatically actuated clamping washer 68 is moved downwardly by pneumatic pressure to clamp the tape and seal around the pocket and is spring biased upwardly away from the tape 40 by springs 70.

The operation of the system 10 can best be understood by referring to the timing diagram of FIG. 4. The timing system 32 operates the sprocket 54 to positively position an encapsulating pocket of the tape over the opening in the outlet header 58 which communicates with the injection tube 26. A combustion cycle, which is best represented by the pressure line 72 in FOG. 4, is then initiated at time zero, by opening the inlet valve 16 as represented by the line 74. Pressure in the combustion chamber 12 then increases to approximately 100 p.s.i. as represented by portion 72*a* of line 72 due to the restrictive outlet nozzle 14 and the high rate at which the fuel-air mixture is injected into the chamber by the high pressure air supply. As the valve 16 closes, an ignition voltage is applied to the spark plug 30 as represented by line 76 to cause ignition of the combustible mixture in the chamber. This results in a very rapid pressure rise as represented by portion 72*b* of the pressure line 72. At approximately the same time that the mixture is ignited by the spark, the pneumatic injection valve 64 is opened as represented by line 78. The high pressure air, which as mentioned is typically 1,000 p.s.i., is then introudced to the inlet header 60 and acts on the top surface of the washer 68, forcing the washer downwardly to clamp the tape and provide a peripheral seal around the encapsulating pocket positioned at the stripping station. The high pressure carrier gas immediately ruptures the tape, thereby stripping the particulate material from the tape and entraining the particulate material in a high velocity, high pressure pneumatic stream which passes through the injector tube 26 into the interior of the combustion chamber 12. As soon as the valve 64 closes, the pressure equalizes around the washer 68 and the springs 70 raise the washer to release the tape. The high pressure blowback from the combustion chamber tends to blow the fractured tape up out of the top of the injector tube 26. The period of injection of the particulate material is represented by the line 80 in FIG. 4. The particulate material is then impacted against the work piece 15 during the interval represented by line 82. It will be noted that the entire combustion cycle occurs within a period of approximately 15 milliseconds, and that the shot of particulate material is added to the combustion chamber during a very short interval of this cycle.

In accordance with another aspect of the invention, the end of the injector tube 26 may be adjustably positioned in the chamber 12 in order to control the period of time that the particulate material remains within the combustion chamber, and thus is heated by the hot gases of combustion. For example, when coating with larger or higher temperature particles, it is sometimes desirable to raise the end of the injector tube 26 relative to the outlet nozzle 14 so that the larger particles will be heated to a higher temperature as a result of the increased retention time within the combustion chamber 12 after combustion of the gases. When shooting finer or lower temperature particles, the injector tube may be placed closer to the nozzle 14.

Adjustment of the location of the end of the nozzle can be achieved using the apparatus illustrated generally by the reference numeral 24*a* in FIG. 5, wherein corresponding conponents of the system illustrated in FIG. 1 are designated by the same reference numerals followed by the reference character "*a*". In this case, the injection tube 26*a* is slidably disposed within the combustion chamber 12*a*, with the annulus therebetween sealed by means of an O-ring 90. The outlet manifold 58*a* is adjustably positioned by means of nuts 92 which are threaded on rods 94, thus raising and lowering the end of the injector tube 26*a*.

Another encapsulating tape in accordance with the present invention is indicated generally by the reference numeral 100 in FIG. 6. The tape 100 has a tubular pocket extending lengthwise which encapsulates the particulate material. The length of each discrete pocket may be varied as desired in order to provide convenient starting and stopping points and is formed by first and second plastic films 102 and 104 of the type heretofore described. The film 102 is channelized to form a tubular cavity for receiving the particulate material 106, while the other film 104 may be substantially flat. The lateral margins of the tapes 102 and 104 are bonded, typically by heat weld seams 108 and 110 along the length of the tape. Because of the substantially uniform cross-section along the length of the tape, the tape encapsulates a predetermined quantity of the particulate material per unit of length. The films 102 and 104 may be of the same thickness or may be relatively thin.

A system for utilizing the encapulating tape 100 is indicated generally by the reference numeral 120 in FIG. 7. The tape 100 is fed from a spool 100a between a pair of fixed cylindrical anvils 122 and 124. Rollers could be used instead of the anvils. The film 102 is pulled around the anvil 122 by a pair of positive drive rollers 126 and is stored on a take-up spool 128 while the film 104 is pulled around anvil 124 by a take-up reel 130. The drive rollers 126 and take-up reel 130 have sufficient power to pull the tapes 102 and 104 and weld seams 108 and 110 apart so that the particulate material 106 is dumped into a pneumatic conduit 132. The stripping apparatus thus far described may be enclosed in an airtight chamber 134.

Oxidizer from a supply 136 is directed under pressure through valve 138 and conduit 132 to a conventional flame gun 140. Gaseous fuel from supply 142 is fed through valve 144 and conduit 146 to the flame gun 140 where it is mixed with the oxidizer and burned in a conventional manner to produce hot gases of combustion which exit from the chamber through a nozzle at high speed to impact a work piece 159. An inert gas or air supply 148 may be provided to pressurize the chamber 134 through an automatic regulator 150 which senses the pressure in the conduit 132 through a control line 152 and adjusts the pressure in the chamber slightly higher than that in the conduit.

In the operation of the system 120, oxidizer and fuel are supplied to the flame gun by opening valves 138 and 144 and the combustible mixture ignited to produce the hot gases which issue at high velocity from the gases. When it is desired to apply particulate material to a work piece 159, the drive rollers 126 are actuated to pull the film 102 over the mandrel 122 as the take-up reel 130 maintains a sufficient tension on the film 104 to separate the two films. The particulate material is thus exposed to the oxidizer stream passing through conduit 132, which functions as a carrier gas, at a uniform rate determined by the rate at which the tape 100 is moved over the mandrel 122.

It will be appreciated that the tape provides a means for very accurately metering the particulate material and facilitates storing and handling of the material.

Further, it is to be understood that the conduit 132 between the point where the particulate material is introduced to the pneumatic stream and the flame gun 140 may be reduced to an absolute minimum in order to improve the control of the powder and also to greatly reduce the wear on the conduit 132 resulting from the high velocity movement of highly abrasive coating material, such as tungsten carbide, to the flame gun.

The purpose of the pressurized enclosure 134 is to equalize the pressure on the tape 100 so that pressure in the conduit 132 will not back up into the tape 100 and cause the tape to rupture. Thus, it will be appreciated that where the pressure within the conduit 132 does not exceed the pressure which can be withstood by the tape 100, a simple seal can be effected around the tape 100 and the films 102 and 104 near the mandrels 122 and 124 in order to reduce the size and complexity of the apparatus. It will also be appreciated that the oxidizer may be air, and that air or an inert gas may be used as the pneumatic carrier in the conduit 132 in place of oxygen, and oxygen supplied to the flame gun from a separate source. In the latter case, the necessity of maintaining a positive pressure differential from the interior of the enclosure 134 to the interior of the conduit 132 would be greatly reduced because of the elimination of the potential hazzard where oxygen is used as the pneumatic carrier. In this latter case, it will be appreciated that the amount of air required to entrain the particulate material can be made very small so as not to materially cool the temperature of the flame in the gun 140. Of course, in many uses of flame guns, it is desirable to introduce an inert gas fo the purpose of reducing the temperature of the flame in which case air or an inert gas can very advantageously be used as the carrier for the particulate material.

Another system which utilizes the encapsulating tape 100 of FIG. 6 is indicated generally by the reference numeral 160 in FIG. 8. Tape from a spool 100*a* is pulled around a stripping mandredl 162 at a controlled rate by a pair of rollers 163 to a take-up 165. A knife 164 splits the film strip 104, as will presently be described in connection with FIG. 9. The apparatus thus far described may be disposed within a pressurized chamber 166. A sutiable carrier gas, typically an inert gas, is provided by a supply 168 through a regulator 170 to the interior of the pressurized chamber 166. A conduit 172 has an open end disposed adjacent the stripping mandrel 162 so that high pressure air rushing from the chamber 166 will entrain particulate material from the tape 100 as will presently be described. The entrained particulate material and carrier gas are then injected in a plasma gun 174.

The plasma gun 174 may be of conventional design, and is of the type that uses an electric art to heat and ionize the inert gas from a gas supply 176 and regulator 178. The particulate material entrained in the carrier gas in the conduit 173 is preferably introduced to the inert gas stream after the inert gas has passed the electrodes to prevent coating the electrodes. However, it is to be understood that the particulate material could be injected into the gaseous stream any desired point, and in some cases, the entire gas supply could pass through the conduit 172. In all cases, the particulate material is heated by the hot gases and accelerated to high velocities to impact the work piece 180.

Referring now to FIG. 9, it will be noted that the channelized film 102 of tape 100 is disposed adjacent the stripping mandrel 162. A knife 164 is disposed so as to split the other film 104 as best seen in the sectional view of FIG. 10. The lower edge of the mandrel 162 has a transverse dimension "*d*" less than the width of the film 102 between the weld lines 108 and 110. Thus, as the tape 100 is pulled around the stripping mandrel 162 by the rollers 163, the knife 164 splits the upper film 104. The resistance of the knife in splitting the film 104 and back tension applied on the spool 100*a* causes the tape 102 to flatten against the mandrel 162 as it passes around the mandrel until it assumes the configuration of the mandrel 162 in the sectional view of FIG. 10. As a result, the particulate material is effectively stripped from the encapsulating tape 100 and entrained in the carrier gas passing into the conduit 172.

An alternative embodiment of the encapsulating tape is indicated generally by the reference numeral 200 in FIG. 12. The tape 200 is similar to the tape 100 and is comprised of a channelized strip of film 202 and a flat strip of film 204 which are welded along seams 206 and 208 and are filled with particulate material 210. However, the flat film strip 204 is scored along a line 212 to materially weaken the strip. If desired, the scoring 212 may actually be perforations to facilitate separation of the film strip 104. The tape 200 may be used in the system 160 without modification except for elimination of the knife 164. As the tape is passed around the stripping mandrel 162 the tension in the tape will force the particulate material 210 outwardly against the film strip 204 causing the film strip 204 to burst along the scored line 212, rather than being cut by the knife 164 as previously described.

From the above detailed description of preferred embodiments of the invention, it will be appreciated by those skilled in the art that a unique and highly advantageous system has been described for handling the particulate material used in both pulse-type and continuous spray-type coating apparatus. The system provides excellent control of the quantity of material delivered to the combustion chamber and thus insures control of the quantity of material deposited on the work piece. The quality of the coating applied to the work piece is insured by the fact that the coating material may be hermetically sealed in the encapsulating tape from the point of manufacture of the particulate material substantially to the point where it is introduced to the combustion chamber. In addition, the particulate material is not subject to segregation of particle size due to handling in bulk. Since the particulate material is stripped from the encapsulating tape, the material of the tape does not contaminate the coating. No valves are required in the pneumatic system after the particulate material is entrained so that the system has a long service life. The system provides such precise control over the instant at which the particulate material is introduced into the combustion cycle of a pulse system that the exact point of introduction can be controlled by positioning the end of the injection tube within the combustion chamber, thus adapting a single machine to apply different sized and different melting point particles as a coating. The encapsulating tape is easily manufactued and the precise quantity of particulate material encapsulated per unit length of the tape is easily controlled simply by filling the deformed tape level full with the particulate material before welding the falt tape in place. The encapsulating tape may be made of inexpensive plastic materials, such as polyethylene, hermetically sealable plastic film material, or other suitable materials.

Although preferred embodiments of the invention have been described in detail, it is to be understood that various changes, substitutions and alterations can be made therein within the spirit and scope of the invention as defined by the appended claims.

What is claimed is:

1. The system for coating a work piece with particulate coating material comprising:

means includng a chamber for producing hot gases within the chamber, the chamber having an open outlet for directing the hot gases against the work piece, an elongated tape having a predetermined quantity of particulate coating material encapsulated therein per unit length of the tape, and stripping means outside the chamber for stripping the particulate material from the tape outside the chamber and then pneumatically transporting and injecting the particulate material into the chamber whereby the particulate materials will be heated by the gases in the chamber and accelerated by the gases escaping through the outlet and impacted against the surface of the work piece.

2. The system of claim 1 wherein the elongated tape forms a plurality of discrete capsules each containing a predetermined quantity of particulate material, the means including the chamber produces a series of pressure pulses within the chamber which causes the hot gases to exit through the outlet opening, the stripping means includes an inlet manifold having an inlet port and an outlet manifold having an outlet port communicating with the chamber for sequentially forming a seal around each of capsules when the tape is clamped between the manifolds, a source of pneumatic pressure greater than the maximum pressure reached in the chamber, first valve means between the source of pneumatic pressure and the inlet port for applying a pneumatic pulse to the inlet port whereby the pneumatic pulse will pass through the capsule and inject the particulate material into the chamber, and control means for operating the valve to apply the pulse of pneumatic pressure to the inlet port in a predetermined time relationship to the pressure pulses produced in the chamber such that particulate material is injected into the chamber during each pressure pulse.

3. The system of claim 2 wherein:

the chamber is a combustion chamber, and further characterized by means for feeding a combustible mixture to the combustion chamber comprising means for producing a combustible fuel-air mixture and second valve means for introducing the fuel-air mixture to the combustion chamber, means for igniting the combustible mixture, and wherein the control means opens the second valve means to charge the combustion chamber with a fuel-air mixture, ignites the fuel-air mixture as the second valve means closes, and opens the first valve means to inject the particulate material into the combustion chamber while the pressure in the chamber is near the maximum pressure resulting from combustion.

4. The system of claim 3 wherein:

the combustion chamber is generally spherical and the outlet opening is a nozzle having a diameter that is small compared to the diameter of the combustion chamber, the outlet port of the outlet manifold comprises an elongated tube extending into the interior of the combustion chamber, and the end of the tube may be adjustably positioned relative to the outlet opening to control the period of time the particulate material is heated by the gases of combustion.

5. The system of claim 1 wherein:

the chamber is of the type which produces a continuous stream of hot gases passing through the outlet, and the stripping means includes means for progressively moving the elongated tape to the stripping station and for progressively pneumatically stripping the particulate material from the tape to thus continuously inject the particulate material into the chamber at a uniform rate.

6. The system of claim 5 wherein the stripping means includes means for mechanically progressively opening the elongated tape before the particulate material is progressively pneumatically stripped from the tape.

7. The system of claim 6 wherein the elongated tape is comprised of at least two film strips and the means for mechanically opening the tape comprising means for separating two film strips.

8. The system of claim 6 wherein the means for mechanically opening the tape comprises means for cutting the tape as the tape is progressively moved to the stripping station.

9. The system of claim 6 wherein the means for mechanically opening the tape comprises means for distorting and bursting the tape.

10. Apparatus for injecting particulate coating material into the heated gases of a system for coating a work piece with particulate material having means for heating the gases and directing the heated gases as a high velocity stream against a work piece which comprises:

an elongated tape having a predetermined quantity of particulate coating material encapsulated therein per unit length of the tape, and stripping means outside the heated gases for stripping the particulate material from the tape and pneumatically injecting the particulate material into the heated gases by means of a carrier gas whereby the particulate materials will be heated and accelerated by the heated gases as the heated gases are directed against the work piece.

11. The apparatus of claim 10 wherein:

the elongated tape forms a pluality of discrete capsules each containing a predetermined quantity of particulate material, and the stripping means includes an inlet manifold having an inlet port and an outlet manifold having an outlet port for communicating with a chamber through which the hot gases pass for sequentially forming a seal around each of the capsules when the tape is clamped between the manifolds, a source of pneumatic pressure greater than the pressure in the chamber, and first valve means for applying a pulse of gas from the pneumatic pressure source to the inlet port whereby the pulse of gas will pass through the capsule and act as a carrier gas to inject the particulate material into the heated gases.

12. The system of claim 10 wherein:

the stripping mens includes means for continuously and progressively moving the elongated tape to the stripping station and for progressively pneumatically stripping the particulate material from the tape for substantially continuously injecting the particulate material into a continuous heated gaseous stream.

13. The system of claim 12 wherein the stripping means includes means for mechanically progressively opening the elongated tape before the particulate material is progressively pneumatically stripped from the tape.

14. The system of claim 13 wherein the elongated tape is comprised of at least two film strips and the means for mechanically opening the tape comprising means for separating two film strips.

15. The system of claim 13 wherein the means for mechanically opening the tape comprises means for cutting the tape as the tape is progressively moved to the stripping station.

16. The system of claim 13 wherein the means for mechanically opening the tape comprises means for distorting the tape until it bursts open.

17. The system for coating a work piece with particulate coating material contained in an elongated tape having a predetermined quantity of particulate coating material encapsulated therein per unit length of the tape, comprising:

a chamber for producing hot gases having an open outlet for directing the hot gases against the work piece, a stripping station outside the chamber, means for feeding the tape to means stripping station at a controlled rate, and stripping mens at the stripping station for stripping the particulate material from the tape entraining the particulate material in a carrier gas stream, and injecting the carrier gas stream and particulate material entrained therein into the chamber whereby the particulate materials will be heated and accelerated by the hot gases escaping through the outlet and impacted against the surface of the work piece.

18. The system of claim 17 wherein the elongated tape forms a plurality of discrete capsules each containing a predetermined quantity of particulate material, and the stripping means comprises:

an inlet manifold having an inlet port and an outlet manifold having an outlet port communicating with the chamber for sequentially forming a seal around each of capsules when the tape is clamped between the manifolds, a source of pneumatic pressure greater than the pressure in the chamber, and first valve means for applying a pulse of gas from the pneumatic pressure source to the inlet port whereby the pulse of gas will pass through the capsule to entrain the particulate material and act as a carrier gas to inject the particulate material into the chamber.

19. The system of claim 18 wherein the chamber is a combustion chamber, and further characterized by:

means for feeding a combustible mixture to the combustion chamber comprising means for producing a combustible fuel-air mixture and second valve means for introducing the fuel-air mixture to the combustion chamber, means for igniting the combustible mixture, and control means for opening the second valve means to charge the combustion chamber with a fuel-air mixture, igniting the fuel-air mixture as the second valve means closes, and opening the first valve means to inject the carrier gas and the particulate material entrained therein into the combustion chamber while the pressure in the chamber is near the maximum pressuring resulting from combustion.

20. The system of claim 19 wherein:

the combustion chamber is generally spherical and the outlet opening is a nozzle having a diameter that is small compared to the diameter of the combustion chamber, the outlet port of the outlet manifold comprises an elongated tube extending into the interior of the combustion chamber, and the end of the tube may be adjustably positioned relative to the outlet opening to control the period of time the particulate material is heated by the gases of combustion.

21. The system of claim 17 wherein:

the chamber is of the type which produces a continuous stream of hot gases passing through the outlet, and the stripping means include means for continuously and progressively moving the elongated tape to the stripping station and for progressively pneumatically stripping the particulate material from the tape and entraining the particulate material in a continuous carrier gas stream to thus continuously inject the particulate material into the chamber at a uniform rate.

22. The system of claim 21 wherein the stripping means includes:

means for mechanically progressively opening the elongated tape before the particulate material is progressively pneumatically stripped from the tape.

23. The system of claim 22 wherein the elongated tape is comprised of at least two film strips and the means for mechanically opening the tape comprises:

means for separating the two film strips.

24. The system of claim 22 wherein the means for mechanically opening the tape comprises:

means for cutting the tape as the tape is progressively moved to the stripping station.

25. The system of claim 22 wherein the means for mechanically opening the tape comprises means for distorting and bursting the tape.

26. Apparatus for injecting particulate coating material from an elongated tape having a predetermined quantity of particulate coating material encapsulated therein per unit length of the tape into the hot gas stream of a system for coating a work piece with particulate material having a chamber for producing hot gases which escape through an outlet opening at high velocity, said injecting apparatus comprises:

a stripping station outside the chamber, means for feeding the elongated tape to the stripping station at a controlled rate, and stripping means for stripping the particulate material from the tape and entraining the particulate material in a carrier gas stream and then injecting the carrier gas stream and the particulate material entrained therein into the chamber whereby the pneumatic stream and particulate materials will be mixed with the hot gas stream and the particulate material will be heated and accelerated by the hot gases escaping through the outlet and impacted against the surface of the work piece.

27. The apparatus of claim 26 wherein the elongated tape forms a plurality of discrete capsules each containing a predetermined quantity of particulate material, and the stripping means comprises:

an inlet manifold having an inlet port and an outlet manifold having an outlet port communicating with the chamber for sequentially forming a seal around each of the capsules, a source of pneumatic pressure greater than the pressure in the chamber, and first valve means for applying a pulse of gas from the pneumatic pressue source to the inlet port whereby the pulse of gas will pass through the capsule to entrain the particulate material and act as a carrier gas to inject the particulate material into the chamber.

28. The system of claim 26 wherein the means for feeding the elongated tape to the stripping station feeds the tape uninterruptively, and the stripping means progressively strips the particulate material from the tape and the carrier gas continuously injects the particulate material into the chamber.

29. The system of claim 28 wherein the stripping means includes means for mechanically progressively opening the elongated tape before the particulate material is progressively pneumatically stripped from the tape.

30. The system of claim 29 wherein the elongated tape is comprised of at least two film strips and the means for mechanically opening the tape comprising means for separating the two film strips.

31. The system of claim 29 wherein the means for mechanically opening the tape comprises means for cutting the tape as the tape is progressively moved to the stripping station.

32. The system of claim 29 wherein the means for mechanically opening the tape comprises means for distorting the tape until the tape bursts open.

* * * * *

UNITED STATES PATENT OFFICE

CERTIFICATE OF CORRECTION

Patent No. 4,067,291 Dated January 10, 1978

Inventor(s) John Allen Park

It is certified that error appears in the above-identified patent and that said Letters Patent are hereby corrected as shown below:

Abstract, line 10, "inlet" should be —outlet—.

Column 1, line 8, after "relates" insert —generally—.

Column 1, line 42, delete "particles" and insert —to—.

Column 1, line 47, "cuases" should be —causes—.

Column 4, line 68, between "air" and "which" insert —supply 18—.

Column 5, line 11, "FOG." should be —FIG.—.

Column 5, line 67, "conponents" should be —components—.

Column 7, line 32, "fo" should be —for—.

Column 7, line 39, "mandredl" should be —mandrel—.

Column 7, line 40, after "take-up" insert —reel—.

Column 7, line 57, "conduit 173" should be —conduit 172—.

UNITED STATES PATENT OFFICE

CERTIFICATE OF CORRECTION

Patent No. 4,067,291 Dated January 10, 1978

Inventor(s) John Allen Park

It is certified that error appears in the above-identified patent and that said Letters Patent are hereby corrected as shown below:

Column 8, line 24, "strip 104" should be —strip 204—.

Column 11, line 4, "mens" should be —means—.

Column 13, line 19, "pressue" should be —pressure—.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*